US006554148B1

(12) United States Patent
Fernandez

(10) Patent No.: US 6,554,148 B1
(45) Date of Patent: Apr. 29, 2003

(54) PEDESTAL DISPLAY AND STORAGE SYSTEM

(76) Inventor: David R. Fernandez, 913 N. Ft. Harrison, Clearwater, FL (US) 33755-3015

( * ) Notice: Subject to any disclaimer, the term of this patent is extended or adjusted under 35 U.S.C. 154(b) by 0 days.

(21) Appl. No.: 09/696,743

(22) Filed: Oct. 25, 2000

(51) Int. Cl.[7] ..... B65D 6/16; B65D 8/14
(52) U.S. Cl. ..... 220/4.33
(58) Field of Search ..... 220/4.33

(56) References Cited

U.S. PATENT DOCUMENTS 3,266,656 A * 8/1966 Kridle ..... 220/4.33
4,050,604 A * 9/1977 Flanders ..... 220/4.33
4,553,680 A * 11/1985 Griggs et al. ..... 220/4.33
4,673,087 A * 6/1987 Webb ..... 220/4.33
4,828,132 A * 5/1989 Franceis, Jr. et al. ..... 220/4.33
5,452,817 A * 9/1995 Taravella et al. ..... 220/4.33
5,566,849 A * 10/1996 Goehner ..... 220/4.33
5,722,551 A * 3/1998 Cocciemiglio, Jr. ..... 220/4.33

FOREIGN PATENT DOCUMENTS

WO WO94/01333 * 5/1993

* cited by examiner

*Primary Examiner*—Joseph M. Moy

(57) ABSTRACT

A pedestal display and storage system which comprises a plurality of rectangular panels. The panels have an upper horizontal edge, a lower horizontal edge and two vertical side edges there between. Also provided is a plurality of pairs of clamps fabricated of a semi rigid resilient plastic material. The clamps are in a generally U-shaped configuration and are coupled to the panels. Next provided is a plurality of normally planar central pivoting members, one for each pair of clamps. Each pivoting member is formed as a strip of material aligned with and attached to the clamps. The member pivotably couples the clamps and the panels. Lastly there is provided a lid which is positionable on the panels. The lid has a top planar piece and a plurality of perpendicular side pieces. The lid functions as for displaying and storing objects.

2 Claims, 3 Drawing Sheets

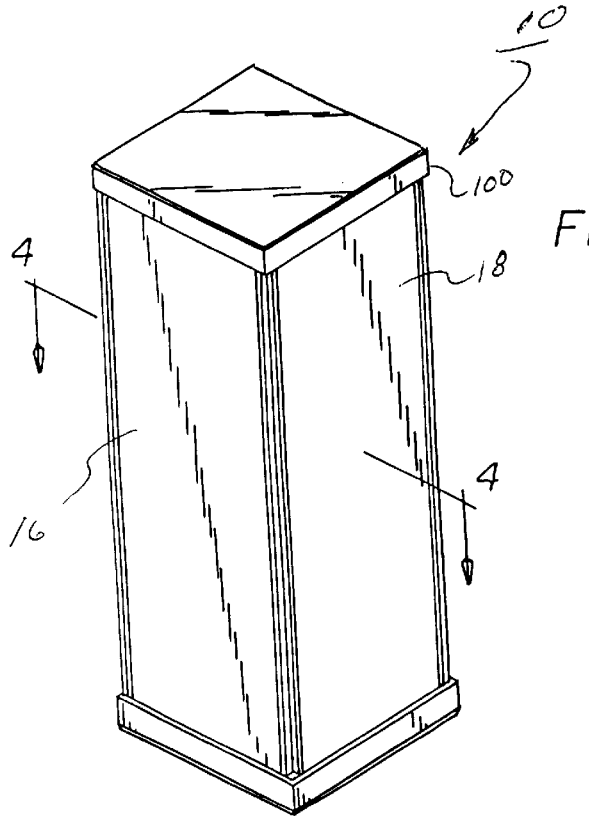
FIG 1
FIG 2
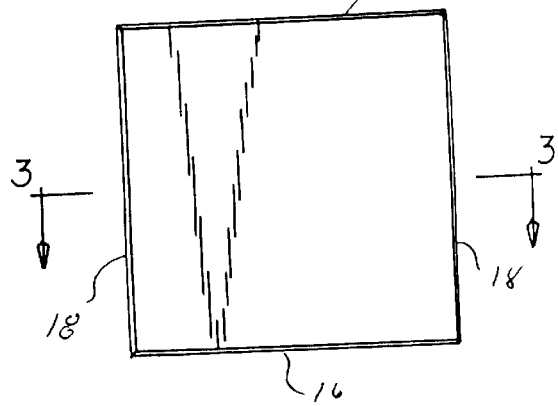

68
20
80
3A
84
24
24
72
26
28
14
70
22

82
86
102
90
96
92
88
84
94
98

5
18
30
16

16
18

PEDESTAL DISPLAY AND STORAGE SYSTEM

BACKGROUND OF THE INVENTION

1. Field of the Invention

The present invention relates to a pedestal display and storage system and more particularly pertains to conveniently and safely placing objects on display, and additionally, for storing the displayed objects.

2. Description of the Prior Art

The use of known methods and apparatuses for displaying objects is known in the prior art. More specifically, known methods and apparatuses for displaying objects previously devised and,utilized for the purpose of displaying articles by known means and methods are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,630,746 issued to Fortenberry on Dec. 23, 1986 discloses a collapsible stackable shipping container. U.S. Pat. No. 5,291,990 issued to Sejzer on Mar. 8, 1994 discloses a ackaging and display system. Lastly, U.S. Pat. No. 4,986,217 issued to Robinson et al on Jan. 22, 1991 discloses a disposable cat litter box.

While these devices fulfill their respective, particular objectives and requirements, the aforementioned patents do not describe a pedestal display and storage system that allows for conveniently and safely placing objects on display, and additionally, for storing the displayed objects.

In this respect, the pedestal display and storage system according to the present invention substantially departs from the conventional concepts and designs of the prior art, and in doing so provides an apparatus primarily developed for the purpose of conveniently and safely placing objects on display, and additionally, for storing the displayed objects.

Therefore, it can be appreciated that there exists a continuing need for a new and improved pedestal display and storage system which can be used for conveniently and safely placing objects on display, and additionally, for storing the displayed objects. In this regard, the present invention substantially fulfills this need.

SUMMARY OF THE INVENTION

In view of the foregoing disadvantages inherent in the known types of other known methods and apparatuses for displaying objects now present in the prior art, the present invention provides an improved pedestal display and storage system. As such, the general purpose of the present invention, which will be described subsequently in greater detail, is to provide a new and improved pedestal display and storage system which has all the advantages of the prior art and none of the disadvantages.

To attain this, the present invention essentially comprises a pedestal display and storage system which may be used to conveniently and safely place objects on display. In addition, the pedestal may be used for storing the displayed objects. The system comprises several components. Firstly, there is a four sided hollow rectilinearly configured tube. The tube is comprised of two equally shaped and equally sized rectangular end panels. In addition there are two equally shaped and equally sized rectangular side panels. Each of the panel has an upper horizontal edge and a lower horizontal edge with two vertical side edges there between. Each end panel has a common length and each side panel has a common length. Each panel also has an inner surface and an outer surface. They also have a common height. Secondly, there are four pairs of clamps with each of the clamps being fabricated of a semi rigid resilient plastic material. Each clamp has a length essentially equal to the height of the walls. Each clamp has a width of between about 0.30 and 0.60 of an inch, and is in a generally U-shaped configuration. Each clamp has a planar inside portion with an inner end and an inner corner and with a planar outside portion parallel with the inner portion having an outer end and an outer corner. There is a middle portion between the inner corner and the outer corner. The middle portion is perpendicular to both the inner portion and the outer portion. Each clamp also has an external surface and an internal surface and an edge there between. The outer portion also has an inward turning tab at the outermost edge along the length of the clamp. The inner portion of the clamp has a smooth internal surface. There are also provided four normally planar central pivoting members, one for each pair of clamps. Each pivoting member is formed as a strip of flexible elastomeric material. Each strip has an inner surface and an outer surface as well as an upper edge and a lower edge with two long side edges there between. The two long side edges of the central pivoting member have a height essentially equal to the height of the panels. The pivoting members have a width of about 0.30 of an inch, plus or minus ten percent. Each pivoting member also is aligned with and attached to the inner corners of the clamps. Additionally, there is provided a coupling interface along the side edges of each pivoting member. The coupling interface securely joins the two associated clamps by the inner corners of the clamps to the two long side edges of the central pivoting member, which is normally coplanar with the inside portions of the clamps. Lastly, there is provided a lid comprised of rigid plastic material. The lid has a top piece and four side pieces. The top piece has an upper surface and a lower surface which are parallel to each other with four perpendicular side edges there between. The side pieces each having an inner surface, an outer surface, an upper edge; a lower edge and two side edges. The upper edges of the side pieces meet and join the side edges of the top at a right angle. The outer upper surface of the top edge and the upper edge of the side pieces have a beveled configuration. There is an adhesive attaching the top and the side pieces together. The top is positioned upon the upper edges of the walls with the inner surfaces of the side pieces of the lid positioned in contact with the upper regions of the side walls. In this configuration the lid functions to stabilize the display tube by containing the side walls and preventing movement. The lid also functions as a recipient surface for an article of art to be displayed upon. The lid may be removed and the article may be stored in the inner confines of the tube, with the lid being replaced and concealing the article of art while maintaining the stability of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pedestal display and storage system which has all of the advantages of the prior art other known methods and apparatuses for displaying objects and none of the disadvantages.

It is another object of the present invention to provide a new and improved pedestal display and storage system which maybe easily and efficiently manufactured and marketed.

It is further object of the present invention to provide a new and improved pedestal display and storage system which is of durable and reliable constructions.

An even further object of the present invention is to provide a new and improved pedestal display and storage system which is susceptible of a low cost of manufacture with regard to both materials and labor, and which accordingly is then susceptible of low prices of sale to the consuming public, thereby making:such a pedestal display and storage system economically available to the buying public.

Even still another object of the present invention is to provide a pedestal display and storage system for conveniently and safely placing objects on display, and additionally, for storing the displayed objects Lastly, it is an object of the present invention to provide a new and improved pedestal display and storage system comprising a plurality of rectangular panels. The panels have an upper horizontal edge, a lower horizontal edge and two vertical side edges there between. Also provided is a plurality of pairs of clamps fabricated of a semi rigid resilient plastic material. The clamps are in a generally U-shaped configuration and are coupled to the panels. Next provided is a plurality of normally planar central pivoting members, there being one for each pair of clamps. Each pivoting member is formed as a strip of material aligned with and attached to the clamps. The member pivotably couples the clamps and the panels. Lastly there is provided a lid which is positionable on the panels. The lid has a top planar piece and a plurality of perpendicular side pieces. The lid also functions as a recipient surface for displaying objects.

These together with other object is of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the pedestal display and storage system.

FIG. 2 is a top plan view of the pedestal display and storage system of FIG. 1.

The same reference numerals refer to the same parts throughout the various Figures.

DESCRIPTION OF THE PREFERRED EMBODIMENT

Figure 3:
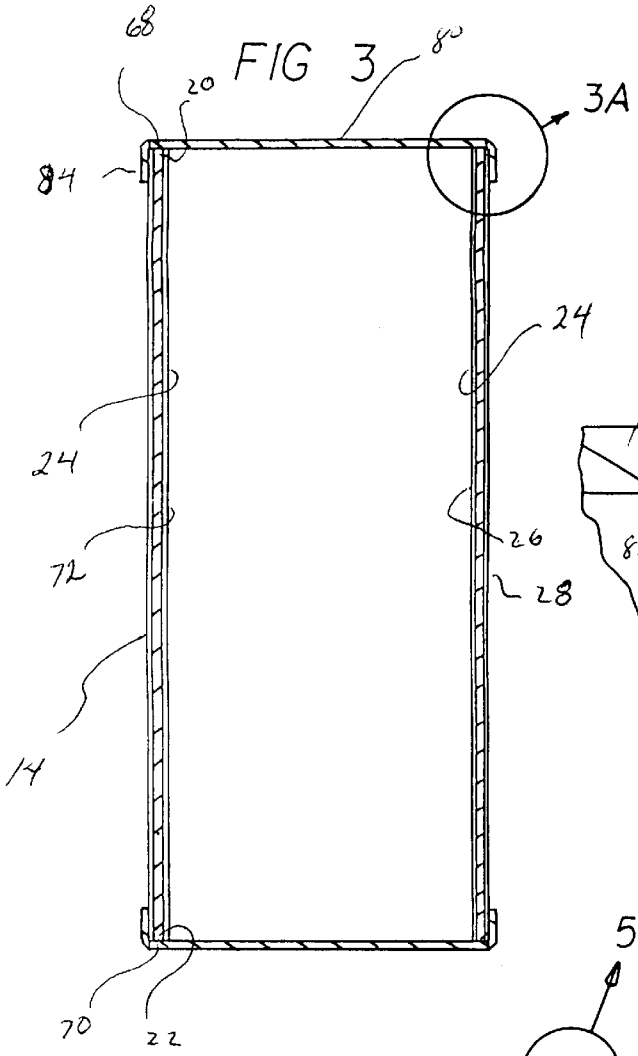
FIG. 3 is a side elevational view taken along line 3—3 of FIG. 2.
Figure 3A:
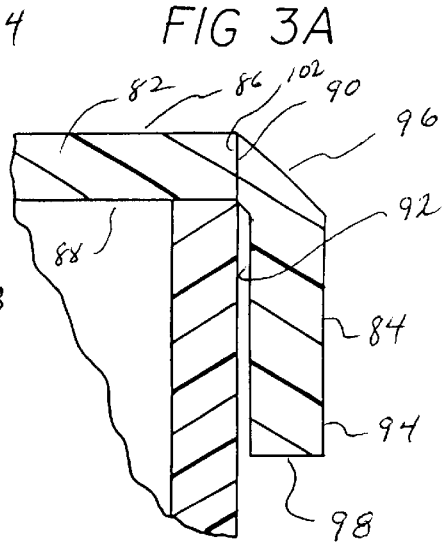
FIG. 3A is an enlarged view taken along circle 3A of FIG. 3.
Figure 4:
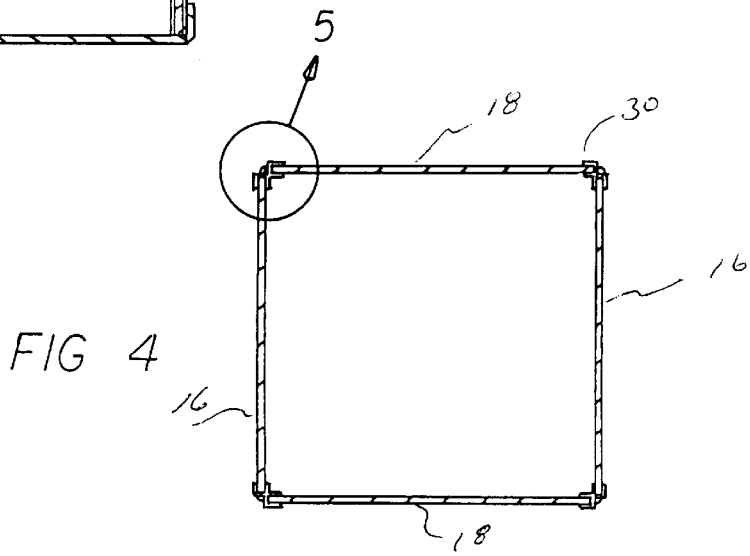
FIG. 4 is a top plan view taken along line 4—4 of FIG. 1.
Figure 5:
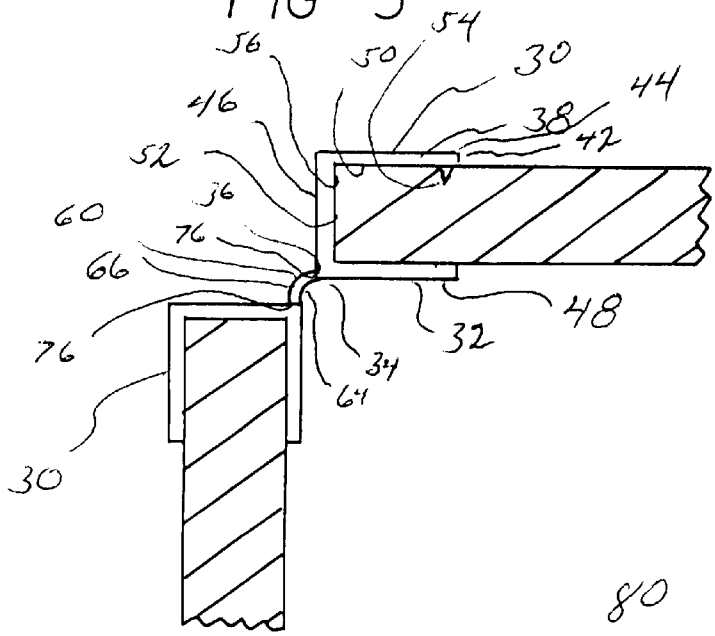
FIG. 5 is a top plan view of the clamp at cirlce 5 of FIG. 4.

With reference now to the drawings, and in particular to FIG. 1 thereof, the preferred embodiment of the new and improved pedestal display and storage system embodying the principles and concepts of the present invention and generally designated by the reference numeral 10 will be described.

The present invention, the pedestal display and storage system 10, is comprised of a plurality of components. Such components in their broadest context include a tube with rectilinear side and end panels, a set of clamps, pivoting members and a lid. Such components are individually configured and correlated with respect to each other so as to attain the desired objective.

The pedestal display and storage system 10 may be used to conveniently and safely place objects on display. In addition, the pedestal may be used for storing the displayed objects.

Firstly, there is a four sided hollow rectilinearly configured tube 14. The tube is comprised of two equally shaped and equally sized rectangular end panels 16. In addition there are two equally shaped and equally sized rectangular side panels 18. It should be noted that the configuration of the side and end panels may be identical as well, with the tube having a square configuration, a rectangle configuration, or a configuration having a different number of panels.

Each of the panel has an upper horizontal edge 20 and a lower horizontal edge 22 with two vertical side edges 24 there between. Each end panel has a common length and each side panel has a common length. Each panel also has an inner surface 26 and an outer surface 28. They also have a common height.

Secondly, there are four pairs of clamps. Each of the clamps 30 is fabricated of a semi rigid resilient plastic material. The clamps are resilient enough to be stretched to accept the end of the panel and yet have enough strength to close and retain the edge within the confines of the clamp.

Each clamp has a length essentially equal to the height of the walls. Each clamp has a width of between about 0.30 and 0.60 of an inch, and is in a generally U-shaped configuration. Each clamp has a planar inside portion 32 with an inner end 34 and an inner corner 36 and with a planar outside portion 38 parallel with the inner portion having an outer end 42 and an outer corner 44. There is a middle portion 46 being between the inner corner 36 and the outer corner 44. The middle portion is perpendicular to both the inner portion and the outer portion. Each clamp also has an external surface 48 and an internal surface 50 and an edge 52 there between. The outer portion also has an inward turning tab 54 at the outermost edge along the length of the clamp for gripping an edge of a panel. The inner portion of the clamp has a smooth internal surface 56.

There are also provided four normally planar central pivoting members 60, one for each pair of clamps. Each pivoting member is formed as a strip of flexible elastomeric material. It is noted that the material if preferably of a type different from that used in the fabrication of the clamps. The pivoting member is preferably adhered to the clamp as by co-extruded and a part of the clamp. Each strip has an inner surface 64 and an outer surface 66 as well as an upper edge 68 and a lower edge 70 with two long side edges 72 there between. The two long side edges of the central pivoting member have a height being essentially equal to the height of the panels. The coupling members have a width of about 0.30 of an inch, plus or minus ten percent. Each pivoting member also is aligned with and attached to the inner corners 36 of the clamps.

Additionally, there is provided a coupling interface 76 along the side edges of each pivoting member. The coupling interface securely joins the two associated clamps by the inner corners of the clamps to the two long side edges of the central pivoting member, which is normally coplanar with the inside portions of the clamps.

Lastly, there is provided a lid 80 comprised of rigid plastic material. The lid has a top piece 82 and four side pieces 84. The top piece has an upper surface 86 and a lower surface 88 which are parallel to each other with four perpendicular side edges 90 there between. The side pieces each have an inner surface 92, an outer surface 94, an upper edge 96, a lower edge 98 and two side edges 100. The upper edges of the side pieces meet and join the side edges of the top at a right angle. The outer upper surface of the top edge and the upper edge of the side pieces have a beveled configuration. There is an adhesive 102 attaching the top and the side pieces together.

The top is positioned upon the upper edges of the walls with the inner surfaces of the side pieces of the lid positioned in contact with the upper regions of the side walls. In this configuration the lid functions to stabilize the display tube by containing the side walls and preventing movement. The lid also functions as a recipient surface for an article of art to be displayed upon. The lid may be removed and the article may be stored in the inner confines of the tube, with the lid being replaced and concealing the article of art while maintaining the stability of the system.

Figure 6:
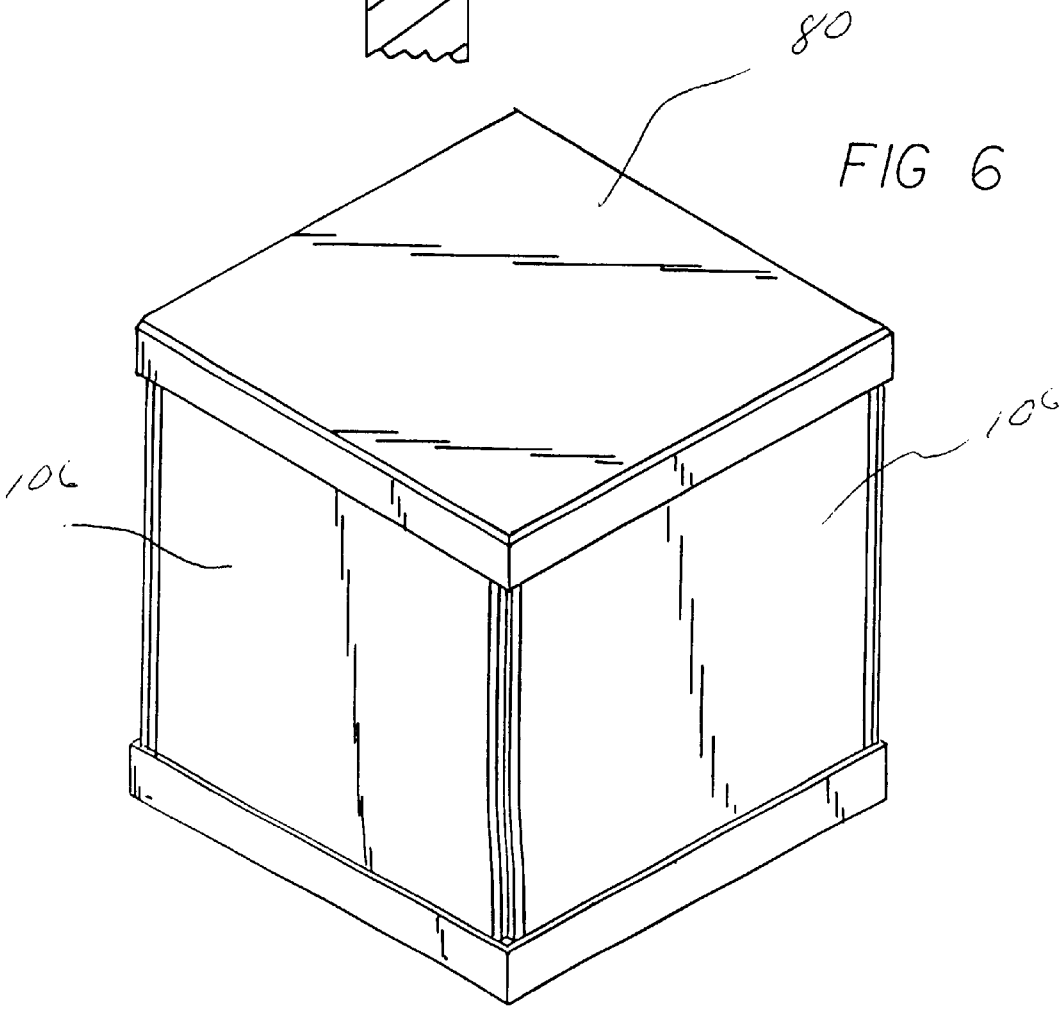
FIG. 6 is a perspective view of a pedestal display and storage system illustrating an alternate embodiment of the invention.

An alternate embodiment is shown in FIG. 6 wherein all side panels 106 are of a square configuration. It should be understood that various sizes of panels or colors thereof may be readily utilized. It should be understood that a supplemental top 80 functioning as a bottom could be utilized for added stability.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pedestal display and storage system for conveniently and safely placing objects on display, and in addition for storing the displayed objects, comprising, in combination:

a four sided hollow rectilinearly configured tube, the tube comprised of two equally shaped and equally sized rectangular end panels and two equally shaped and equally sized rectangular side panels, each panel having an upper horizontal edge and a lower horizontal edge and two vertical side edges there between, each end panel having a common length, and each side panel having a common length, each panel also having an inner surface and an outer surface and a common height;

four pairs of clamps, each clamp fabricated of a semi rigid resilient plastic material with a length essentially equal to the height of the walls and a width of between about 0.30 and 0.60 of an inch, each clamp being in a generally U-shaped configuration, with a planar inside portion having an inner end and an inner corner and with a planar outside portion parallel with the inner portion having an outer end and an outer corner and with a middle portion being between the inner corner and the outer corner and being perpendicular to both the inner portion and the outer portion, each clamp also having an external surface and an internal surface and an edge there between, the outer portion also having an inward turning tab at the outermost edge along the length of the clamp, and the inner portion of the clamp having a smooth internal surface;

four normally planar central pivoting members, one for each pair of clamps, each pivoting member being formed as a strip of flexible elastomeric material, each strip having an inner surface and an outer surface with an upper edge and a lower edge and two long side edges there between, the two long side edges of the central pivoting member being of a height essentially equal to the height of the panels and a width of about 0.30 of an inch, plus or minus ten percent, each pivoting member also being aligned with and attached to the inner corners of the clamps to allow pivoting of the clamps and the panels with respect to each other;

a coupling interface along the side edges of each pivoting member and two associated clamps by which the inner corners of the clamps are joined securely with and to the two long side edges of the central pivoting member normally coplanar with the inside portions of the clamps; and, a lid comprised of rigid plastic material, having a top piece and four side pieces, the top having an upper surface and a lower surface parallel to each other and four perpendicular side edges there between, the side pieces each having an inner surface and an outer surface and an upper edge and a lower edge and two side edges, the upper edges of the side pieces meeting and joining the side edges of the top at a right angle, with the outer upper surface of the top edge and the upper edge of the side pieces having a beveled configuration and with an adhesive attaching the top and the side pieces are joined and held together, the top positioned upon the upper edges of the walls with the inner surfaces of the side pieces of the lid positioned in contact with the upper regions of the side walls wherein lid functions to stabilize the display tube by containing the side walls and preventing movement, the lid also functioning as a recipient surface for an article of art to be displayed, furthermore the lid may be removed and the article may be stored in the inner confines of the tube, with the lid being replaced and concealing the article of art while maintaining the stability of the system.

2. A pedestal display and storage system comprising:

four rectangular panels having an upper horizontal edge and a lower horizontal edge and two vertical side edges there between, each panel also having an inner surface and an outer surface;

four pairs of clamps fabricated of a semi rigid resilient plastic material in a generally U-shaped configuration coupled to the panels, each clamp having a planar inside portion adjacent to the inside surface of its associated panel and a parallel outside portion adjacent to the outside surface of its associated panel and a middle portion coupling the inside portion and the outside portion to thereby form an inside corner and an outside corner;

a plurality of normally planar central pivoting members fabricated of a flexible elastomeric material, one for each pair of clamps, each pivoting member being formed as a strip of material aligned with and attached to the clamps at adjacent inside corner for pivotably coupling the clamps and the panels to allow pivoting of the clamps and the panels with respect to each other; and a lid positionable on the panels having a top planar piece and a plurality of perpendicular side pieces, with the lid functions for displaying and for storing objects.

* * * * *